US012398969B2

(12) United States Patent
Toner et al.

(10) Patent No.: US 12,398,969 B2
(45) Date of Patent: Aug. 26, 2025

(54) HANDGUN COMPENSATOR

(71) Applicant: Sig Sauer, Inc., Newington, NH (US)

(72) Inventors: Sean P. Toner, Merrimack, NH (US); Luke Morenz, Dover, NH (US); Liam Taylor, Barrington, NH (US); Adrian Thomele, Stratham, NH (US); Phillip Strader, Stratham, NH (US)

(73) Assignee: SIG SAUER INC., Newington, NH (US)

( * ) Notice: Subject to any disclaimer, the term of this patent is extended or adjusted under 35 U.S.C. 154(b) by 0 days.

(21) Appl. No.: 18/359,344

(22) Filed: Jul. 26, 2023

(65) Prior Publication Data

US 2024/0191960 A1 Jun. 13, 2024

Related U.S. Application Data

(60) Provisional application No. 63/369,794, filed on Jul. 29, 2022.

(51) Int. Cl.
*F41A 21/36* (2006.01)

(52) U.S. Cl.
CPC ..... *F41A 21/36* (2013.01)

(58) Field of Classification Search
CPC ..... F41A 21/32; F41A 21/325; F41A 21/34; F41A 21/36; F41A 21/38
See application file for complete search history.

(56) References Cited

U.S. PATENT DOCUMENTS

| | | | | |
|---|---|---|---|---|
| 4,691,614 | A * | 9/1987 | Leffel | F41A 21/36 89/14.3 |
| 4,709,497 | A * | 12/1987 | Resca | F41A 25/22 89/14.3 |
| 9,551,545 | B1 * | 1/2017 | Rowe | F41A 11/00 |
| 9,995,550 | B2 | 6/2018 | Shelton et al. | |
| 10,767,952 | B1 * | 9/2020 | Till | F41A 21/325 |
| 11,480,414 | B2 | 10/2022 | Salinas et al. | |

(Continued)

OTHER PUBLICATIONS

Armory Craft, "Armory Craft P365 Comp Slide with RMSc Optics Cut" available at https://www.armorycraft.com/product-page/armory-craft-p365-comp-slide-with-rmsc-optics-cut (Retrieved May 2022).

(Continued)

*Primary Examiner* — Bret Hayes
(74) *Attorney, Agent, or Firm* — Finch & Maloney PLLC

(57) ABSTRACT

A recoil compensator for a handgun defines a through opening along a central axis, the through opening including a threaded portion configured to threadably engage the threads on the distal end portion of the barrel. The recoil compensator further defines a port in a top wall and defines fastener openings each configured to receive a taper pin. When the recoil compensator is installed on the barrel, the central axis is substantially coincident with the bore axis and the port is configured to vent a portion of propellant gases from the barrel upon firing the handgun. The threaded portion threadably engages the threads on the barrel with a distal end of the barrel positioned proximally of the port. Each taper pin is received in a respective fastener opening and engages a side of the barrel. A slide assembly and handgun including the compensator are also disclosed.

22 Claims, 10 Drawing Sheets

(56) References Cited

U.S. PATENT DOCUMENTS

| | | | | |
|---|---|---|---|---|
| 2014/0075800 | A1* | 3/2014 | Morris, Jr. | F41A 21/36 42/1.06 |
| 2019/0154388 | A1* | 5/2019 | Jager | F41G 1/02 |
| 2019/0390930 | A1* | 12/2019 | Fan | F41A 21/36 |
| 2022/0042759 | A1* | 2/2022 | Holly | F41C 9/085 |
| 2023/0228515 | A1* | 7/2023 | Roe | F41A 21/325 89/14.05 |
| 2024/0401912 | A1 | 12/2024 | Salinas et al. | |
| 2025/0052532 | A1 | 2/2025 | Underwood et al. | |
| 2025/0085075 | A1 | 3/2025 | Underwood et al. | |

OTHER PUBLICATIONS

Bell, William, Personal Defense World, "DE50SRMB: MRI's Desert Eagle Mark XIX Pistol with Integral Muzzle Brake" available at https://www.personaldefenseworld.com/2015/09/de50srmb-mris-desert-eagle-mark-xix-pistol-with-integral-muzzle-brake/ (Sep. 30, 2015).

Glock, "Glock Compensated Models, Reduced recoil and increased precision" available at https://eu.glock.com/en/technology/compensator-pistols (Retrieved May 2022).

Zev Technologies, "OZ9C Elite Hyper-Comp Pistol, Compact Black Slide, Bronze Barrel" available at https://www.zevtechnologies.com/OZ9c-Hyper-Comp-Pistol-Compact-Black-Slide-Bronze-Barrel (Retrieved May 2022).

Wise Lite Arms, "The P.E.W.—Port Enhanced Weapon System For Glock Slide Compensation and Barrel Porting" available at https://www.wlarms.com/Port-Enhanced-Weapon-System-p/pew098.htm (Retrieved May 2022).

Trinity Nevada, "Ground Breaker Complete Slide" available at https://trinitynevada.com/products/compensated/ground-breaker-complete-slide/ (Retrieved May 2022).

Honest Outlaw Reviews, YouTube.com, "Trinity Nevada Ground Zero 1000 Round Review" available at https://www.youtube.com/watch?v=i_P1oolWcll (Oct. 25, 2020).

* cited by examiner

HANDGUN COMPENSATOR

RELATED APPLICATIONS

This application claims the benefit under 35 U.S.C. § 119(e) of U.S. Provisional Patent Application No. 63/369,794 titled HANDGUN COMPENSATOR, and filed on Jul. 29, 2022, the contents of which are incorporated herein by reference in its entirety.

TECHNICAL FIELD

The present disclosure relates generally to handguns and more specifically to a compensator attachment for a handgun.

BACKGROUND

A muzzle brake or recoil compensator is a type of muzzle device for a firearm that is designed to reduce muzzle rise or "muzzle flip" by redirecting a portion of propellant gases leaving the barrel. Some compensators can be attached to the barrel, such as threading the device onto a handgun barrel or rifle barrel. Other compensators are integral to the barrel, such as when the barrel defines ports along the length of the barrel to vent gases. Whether using an attachment or ports in the barrel, the burst of propellant gases is directed upward to counter recoil forces that tend to make the muzzle rise upon shooting the firearm. A recoil compensator or simply "compensator" may be used on a handgun with the advantage of enabling the shooter to more quickly realign sights on a target for the next shot.

SUMMARY

One aspect of the present disclosure is directed to a compensator attachment for a handgun barrel. In one example, the compensator can be secured to the distal end of the barrel using fasteners, such as taper pins or cam pins, installed through the compensator after threading the compensator onto the barrel. Also disclosed is a slide assembly including the compensator as well as a firearm including the compensator or slide assembly.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
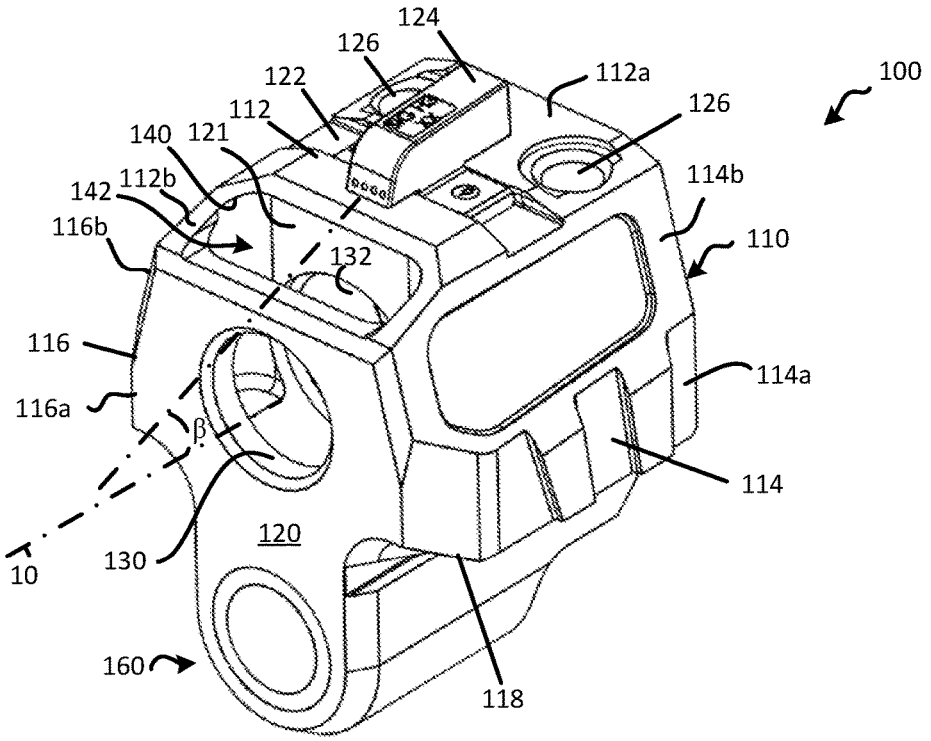
FIG. 1 illustrates a front and top perspective view of a compensator for a handgun, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a compensator for a semiautomatic handgun. In one example, the compensator is configured to attach to the distal end portion of a barrel and can be secured using fasteners. For example, the compensator can threadably engage a threaded portion of the barrel or can use a slip fit over a threaded or non-threaded end portion of a barrel. The compensator can be secured to the barrel using one or more taper pins or threaded pins that extend through the compensator and engage the barrel, such as a flat or recess in the sides of the barrel. The use of taper pins or similar fastener provide a mechanical stop that prevents rotation of the compensator after the compensator is threaded onto the barrel.

In one embodiment, the compensator extends beyond the end of the barrel and has one or more ports positioned to direct a portion of propellant gases upward through the port(s) to counter act recoil forces that typically cause muzzle rise. For example, a port in the upper wall of the compensator directs gases upward and forward. The port is positioned distally of the distal end of the barrel. In other embodiments, the compensator defines two or more ports spaced laterally and/or axially.

The top wall of the compensator optionally defines a dovetail slot for attachment of a front sight. In one such embodiment, the front sight is effectively fixed to the barrel by being attached to the compensator and therefore does not cycle rearward and forward with the slide. When the front sight is attached to the compensator, rather than the slide, the front sight can be positioned further forward, resulting in an increased sight radius compared to a sight attached to a slide that terminates at the end of the barrel.

Overview

Existing handgun compensators can be threaded onto the threaded end of a handgun barrel. Despite tightening the compensator during installation, a combination of recoil forces, vibration, and thermal expansion cycles can loosen the engagement between the compensator and the barrel, resulting in rotation or loss of the compensator. When the front sight is mounted to the compensator, even slight rotation of the compensator can result in changes in the sight alignment that result in the shooter missing the target. Accordingly, it would be desirable to improve mounting techniques for a compensator for a handgun. Despite updates and development to handgun compensators, numerous non-trivial challenges remain.

To address these needs and others, the present disclosure is directed to a handgun compensator that utilizes a combination of threaded engagement and fasteners, such as a screw or taper pin, to prevent rotation of the compensator. Numerous variations and embodiments will be apparent in light of the present disclosure.

Example Embodiments

Figure 2:
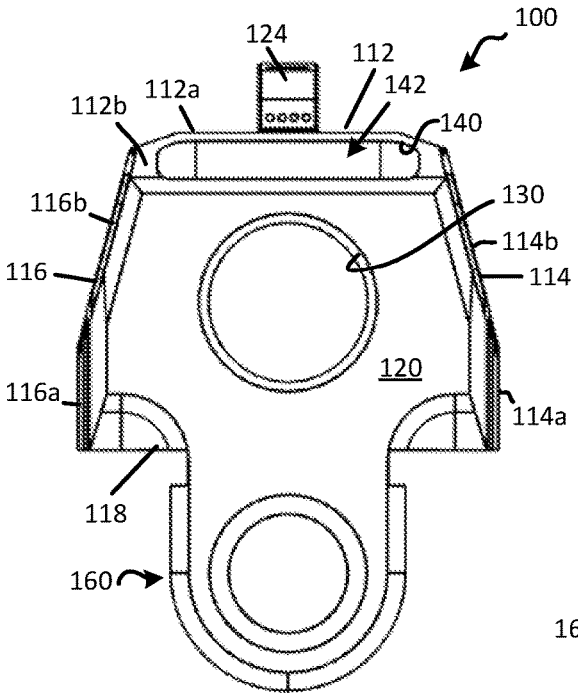
FIG. 2 is a front view of the compensator of FIG. 1.
Figure 3:
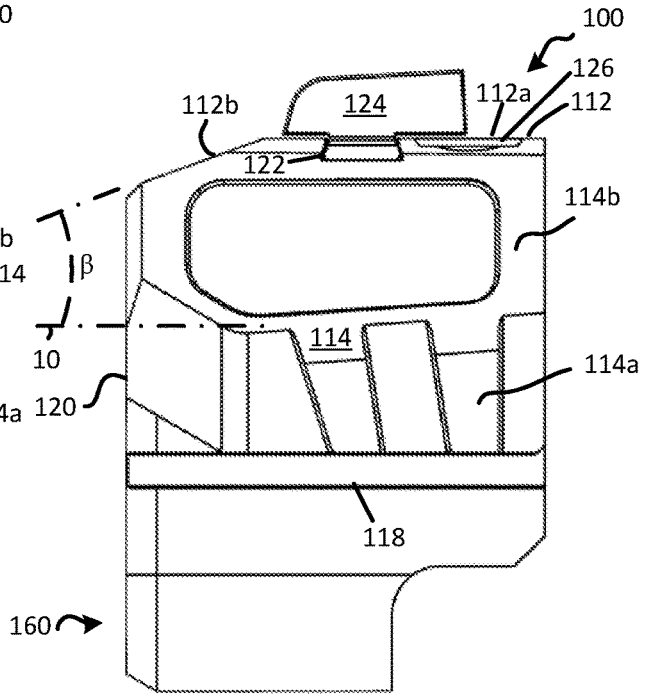
FIG. 3 is a side view of the compensator of FIG. 1.
Figure 4:
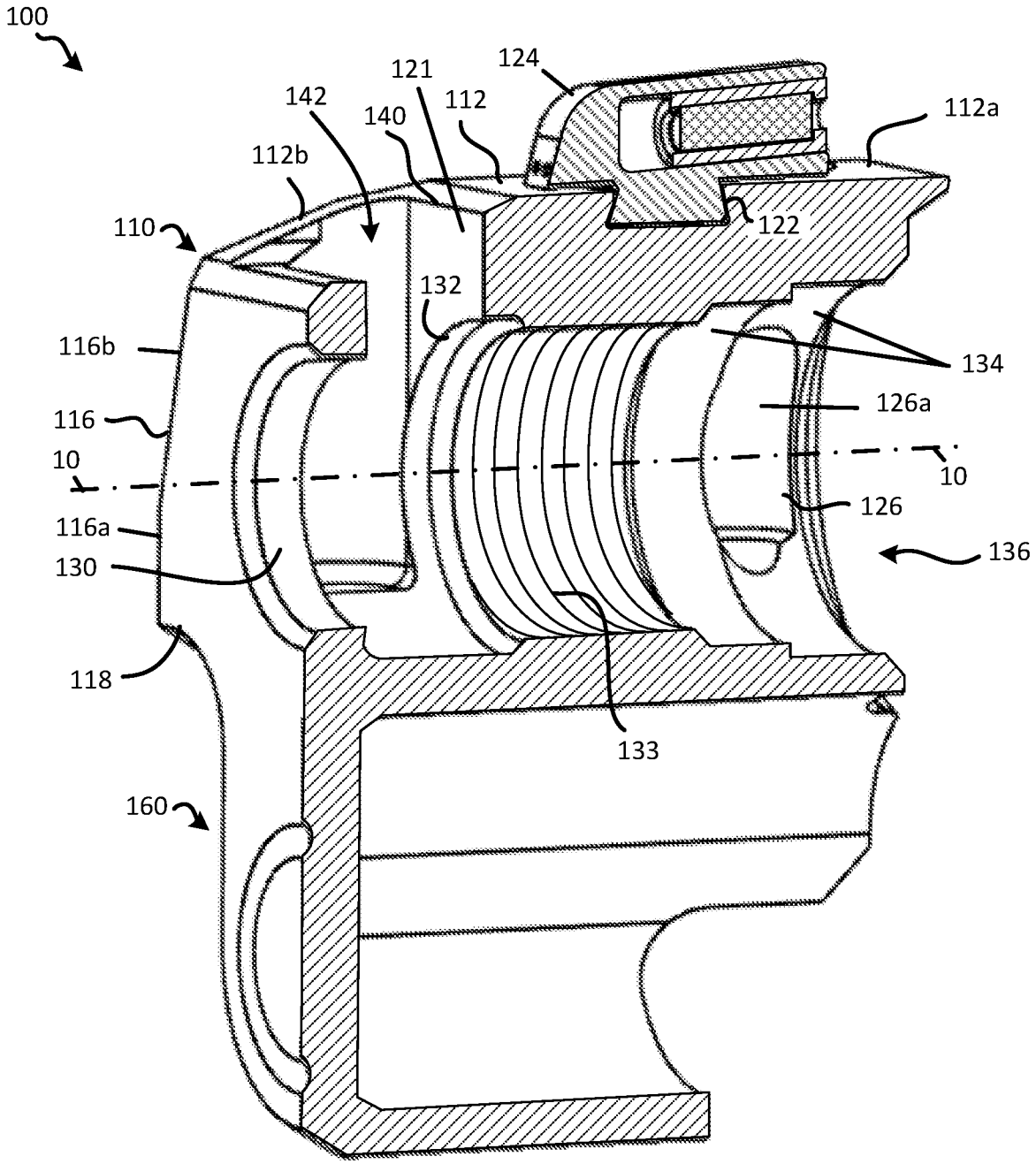
FIG. 4 is a front perspective view showing a longitudinal section of the compensator of FIG. 1.

FIGS. 1-4 illustrate a handgun compensator 100 in accordance with an embodiment of the present disclosure. FIG. 1 is a front perspective view, FIG. 2 is a front view, FIG. 3 is a side view, and FIG. 4 is a perspective view showing a longitudinal section. These figures are discussed concurrently below.

The compensator 100 has an upper portion 110 that is configured to install over the distal end of a handgun barrel. The upper portion 110 is generally configured to have the same profile as the handgun slide, such as appearing as an extension of the slide. In one such embodiment, the upper portion of the compensator mimics the handgun slide by having a geometry and other features consistent with those of the handgun slide. In one example, the upper portion has a top wall 112, side walls 114, 116 depending downward from the top wall, and a bottom wall 118. The upper portion 110 can have a cuboid shape, such as a rectangular, trapezoidal, or oval cross-sectional shape, for example. A distal wall 120 connects to the other walls 112, 114, 116, 118 and defines the distal end of the compensator 100 as well as an open region at the end of the barrel that directs a portion of propellant gases through a port in the top wall.

In the example of FIGS. 1-4, each of side walls 114, 116 includes a substantially vertical section 114*a*. 116*a* and a sloped section 114*b*, 116*b* that slopes linearly downward and outward from the top wall 112 to the respective vertical section 114*a*, 116*a*. As shown, the upper portion 110 is configured to simulate an extension of the handgun slide of the handgun with which the compensator 100 is intended to be used. However, having the same or similar appearance as the handgun slide is not required; more generally, any one or more of the walls of the upper portion can have a planar geometry, an arcuate geometry, a folded geometry (e.g., having multiple planar sections), a complex geometry (e.g., faceted), or a combination of these features.

The top wall 112 includes a generally planar portion 112*a* that extends along the bore axis 10. In some embodiments, the top wall 112 may also include a sloped portion 112*b* that extends downward and forward from the planar portion 112*a* to the distal wall 120. In some embodiments, the sloped portion 112*b* of the top wall 112 joins the planar portion 112*a* at or in front of the end of the handgun's barrel. When present, the sloped portion 112*b* can define an angle β with the bore axis 10 from 5 to 45°, including 10-35°, 10-20°, 15-30°, 20-30°, or about 20°, for example.

In this example, the sloped portion 112*b* defines one or more ports 140 positioned and configured to vent a portion of propellant gases from the barrel. In the example of FIGS. 1-4, the sloped portion 112*b* defines a single port 140 that extends laterally between (and substantially extending to) the sloped sections 114*b*, 116*b* of side walls 114, 116. Note that port 140 has a width that is greater than the diameter of a projectile opening 130 in the distal wall 120 and that is also greater than the diameter of the barrel opening 132 located proximally of the projectile opening 130 in an intermediate wall 121. In other embodiments, the port can have a size or diameter that is smaller than the projectile opening 130. For example, the port 140 can be one or more bores formed in the top of the compensator 100.

Between the barrel opening 132 and the projectile opening 130 the compensator 100 defines an open volume 142 positioned axially between the distal wall 120 and the intermediate wall 121, and positioned laterally between side walls 114, 116. As can be seen, for example, in FIGS. 1 and 4, the volume 142 permits gas expansion laterally and vertically prior to exiting through the projectile opening 130 and port 140.

The compensator 100 defines one or more fastener openings 126, each configured and positioned for a taper pin or other fastener to be installed. Part of the fastener opening 126 can be threaded in some embodiments. In one example, the fastener is a taper pin, where the taper pin engages an outer surface of the barrel, as discussed in more detail below. In one embodiment, the top wall 112 defines two fastener openings 126 on opposite sides of the barrel, each of which is positioned so that a fastener installed through the respective fastener opening 126 engages the outer surface of the barrel, such as a flat or recess. As shown in FIG. 4, for example, each fastener opening 126 intersects the respective side wall 114, 116 along an inside of the compensator 100. As such, each side wall 114, 116 defines a pocket 126*a* to receive part (e.g., a shaft) of the taper pin. When installed, the taper pin can engage the barrel and the sidewall 114/116 along the pocket 126*a* to result in a mechanical stop that prevents rotation of the compensator on the barrel. The fastener opening(s) 126 can be positioned axially so that each taper pin 176, when installed, alternately or additionally creates a binding condition with the threads 133 in the barrel opening 132. For example, as the fastener is installed, it forces the compensator 100 to shift slightly axially to bind the threads. At the same time, the fastener binds between the barrel and pocket 126*a*, fixing the compensator 100 to the barrel and preventing rotation.

In this example, each fastener opening 126 extends vertically through the top wall 112 (e.g., perpendicular to the bore axis 10) when the bore axis 10 is horizontal. In other embodiments, the fastener opening(s) 126 can extend at some other angle through the top wall 112 (or other wall). For example, fastener openings 126 can extend through the top wall 112 in a downward and laterally outward direction. In yet other embodiments, each fastener opening 126 extends laterally through one of the side walls 114/116. Numerous variations and embodiments will be apparent in light of the present disclosure.

In some embodiments, part of the fastener opening 126 is threaded. For example, the portion of the fastener opening 126 through the top wall 112 is threaded, while the remainder of the fastener opening 126 is configured to receive a smooth taper or straight shaft on the fastener 176. In another example, the bottom of the pocket 126*a* is threaded, such as for a fastener having a threaded tip.

Optionally, the top wall 112 defines a dovetail slot 122 extending crosswise to the bore axis 10, the dovetail slot 122 configured for attachment of a front sight 124. The top wall 112 optionally can further define one or more threaded bores (not shown) for securing the front sight in the dovetail slot 122.

The projectile opening 130 is the distal opening of a through-bore 136 that extends through the upper portion 110 along a bore axis 10. The through-bore 136 is configured for passage of a projectile and propellant gases when the gun is fired. At least part of the through-bore 136 is sized to receive the distal end portion of the handgun barrel. Part of the through-bore 136 can include threads 133 for threadably engaging a threaded barrel. As shown in the sectional view of FIG. 4, for example, the through-bore 136 includes projectile opening 130, barrel opening 132 (threaded in this example), and one or more additional diameters 134 located proximally of the threaded barrel opening 132. In some embodiments, each additional diameter 134 is greater than the diameter of the barrel opening 132 and corresponds to a portion of the barrel of greater diameter. In other embodiments, the barrel opening 132 is a smooth bore configured for a slip fit over a smooth or threaded barrel.

In some embodiments, the compensator 100 has a lower portion 160 attached to and positioned below the upper portion 110. In some embodiments, the lower portion 160 simulates a spring box of the handgun slide, or an extension thereof, such as having a reduced width compared to the upper portion 110. The lower portion 160 can be hollow in some embodiments.

Figure 5:
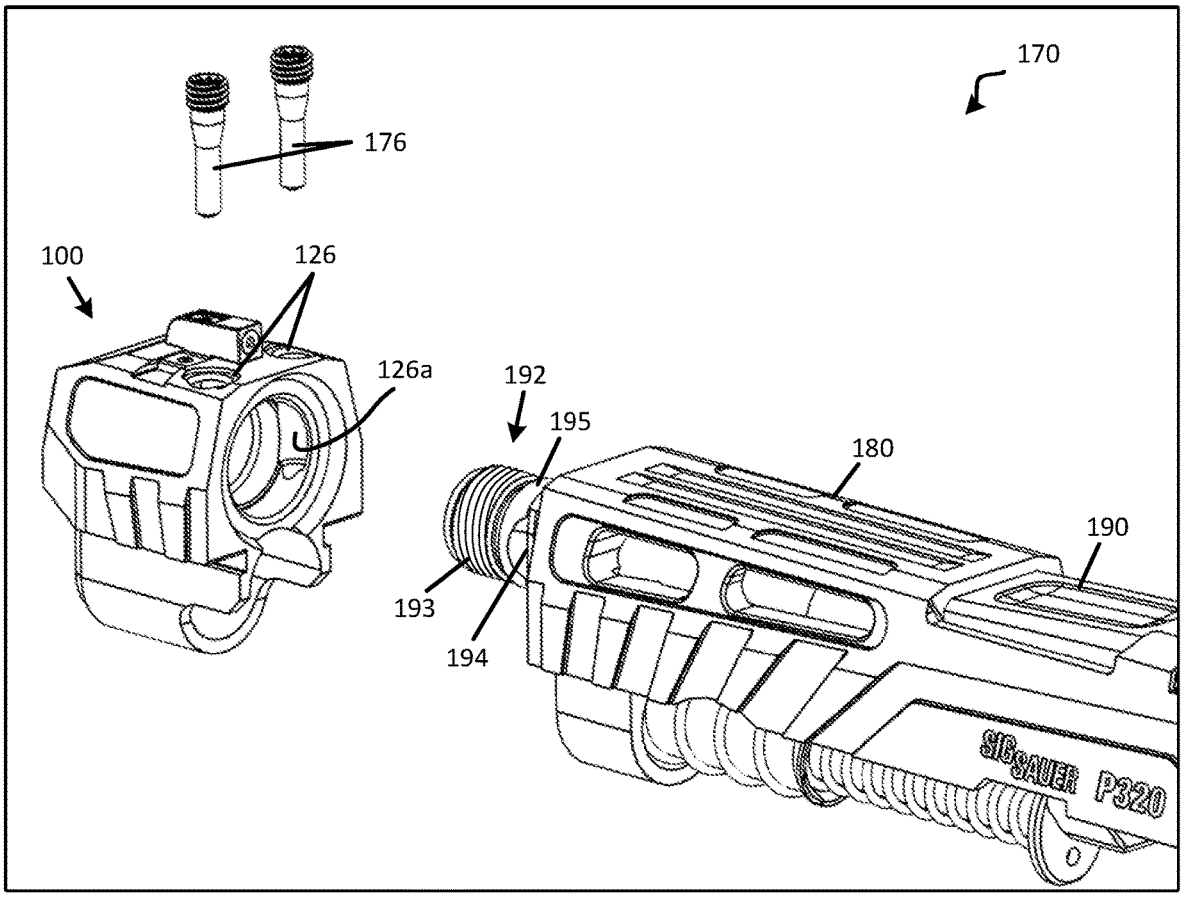
FIG. 5 is a top and rear perspective view showing part of a handgun slide and a compensator in a disassembled form, in accordance with an embodiment of the present disclosure.

FIG. 5 is a rear perspective view showing a slide assembly 170 in a partially disassembled state, where the slide assembly 170 includes a compensator 100, one or more fasteners 176, a handgun slide 180, and a threaded barrel 190. When the barrel 190 is installed in the slide 180, the distal end portion 192 of the barrel 190 extends beyond the end of the slide 180. The distal end portion 192 includes a threaded portion 193 and region of greater diameter 195 behind the threaded portion 193. Lateral sides of the distal end portion 192 define recesses or flats 194. Each flat 194 is positioned behind the threaded portion 193 and is configured to engage a fastener 176, such as a taper pin. In other embodiments, the flats 194 can be forward of the threaded portion 193.

The compensator 100 can be configured as discussed above with reference to FIGS. 1-4. As seen here, the compensator 100 includes fastener openings 126 and corresponding pockets 126*a* along the inside of the compensator 100. In this example, each fastener opening 126 is threaded through part of all of its length through the top wall 112, so as to threadably engage a fastener 176 having a threaded head and having a smooth (non-threaded) shaft. The compensator 100 defines a threaded barrel opening 132 (not visible) that threadably engages the threaded portion 193 of the barrel 190. After threading the compensator 100 onto the barrel 190, fasteners 176 can be installed into fastener openings 126 to fix the rotational position of the compensator 100 by creating a mechanical stop between the barrel 190 and the compensator 100.

Figure 6:
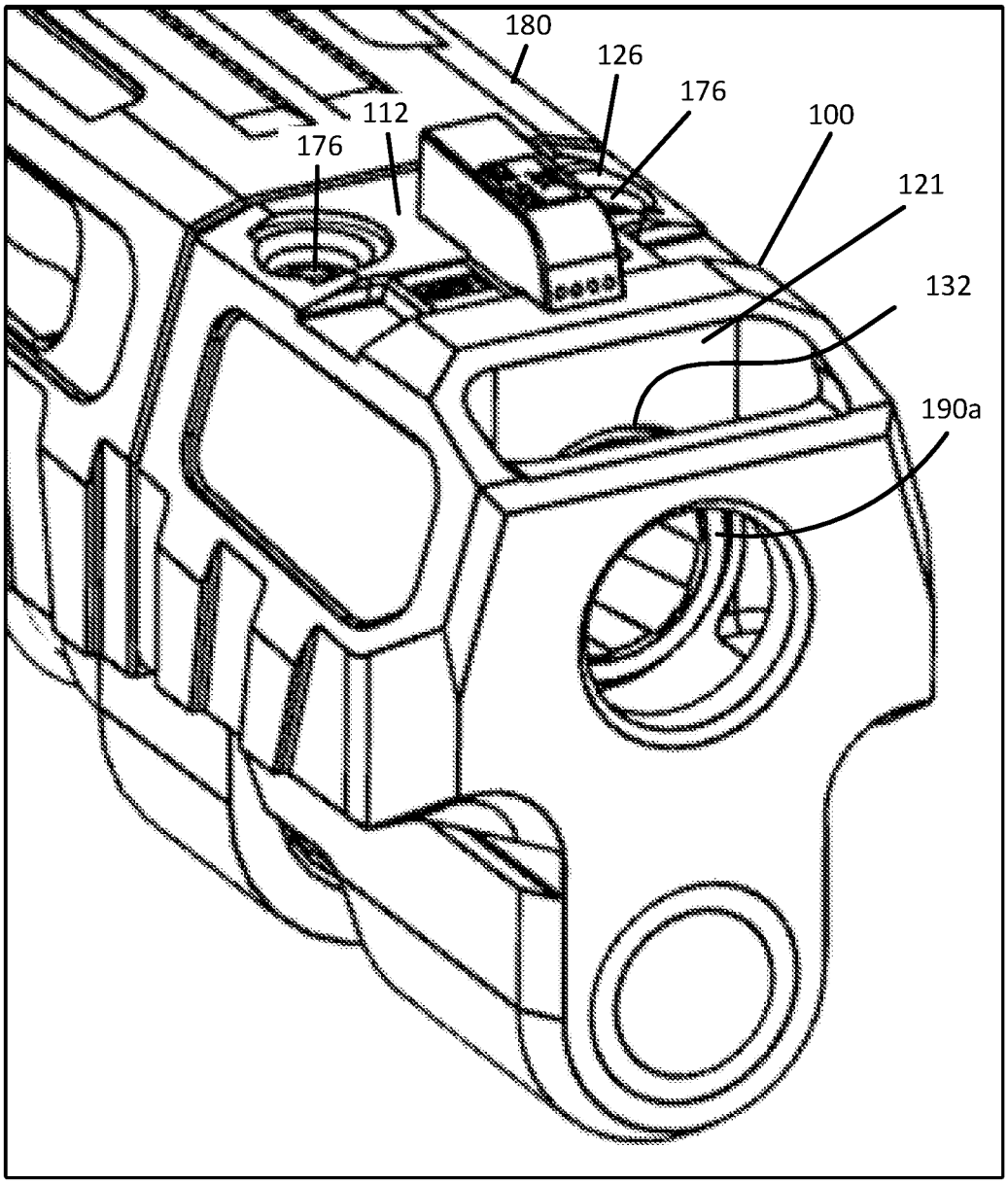
FIG. 6 is a front perspective view of a distal end portion of a handgun slide with a compensator attached to the barrel, in accordance with an embodiment of the present disclosure.

FIG. 6 illustrates a front perspective view of a distal end portion of a handgun slide 180 and a compensator 100 installed on the barrel 190. Fasteners 176 are recessed into the top wall 112 of the compensator 100. The distal end 190*a* of the barrel 190 is substantially flush with the barrel opening 132 in the intermediate wall 121. In this example, the compensator 100 has a geometry and appearance that is consistent with that of the handgun slide 180, thereby simulating an extension of the slide 180.

Figure 7:
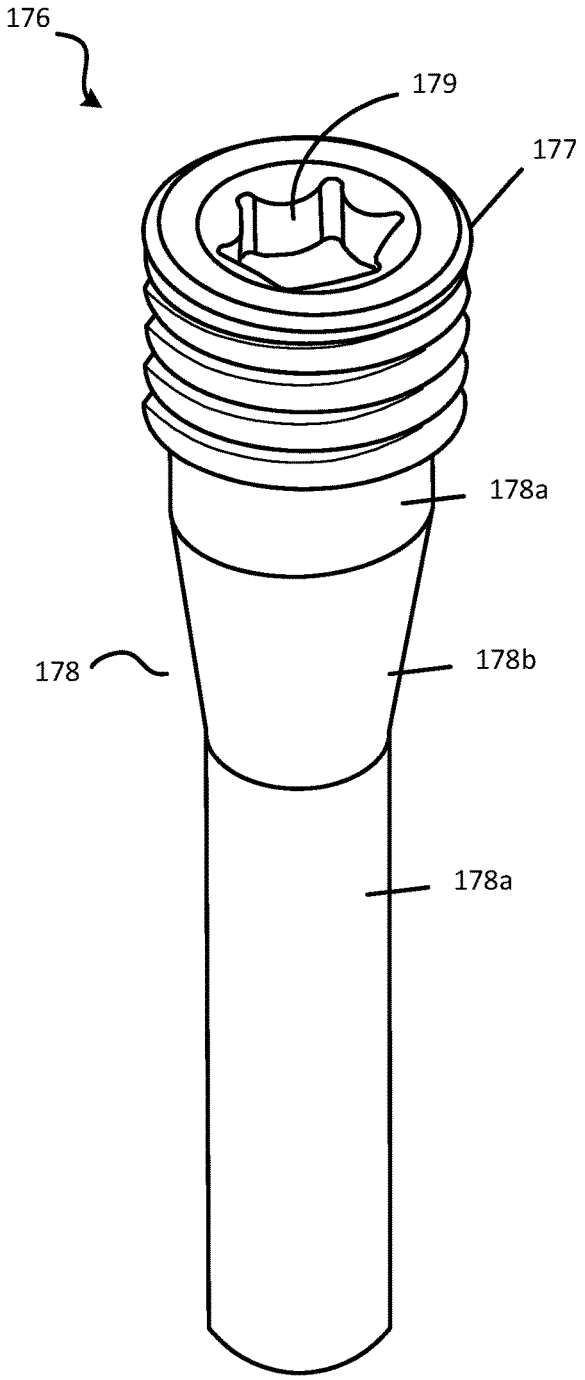
FIG. 7 is a perspective view of a fastener that can be used to secure a compensator to a handgun barrel, in accordance with an embodiment of the present disclosure.
Figure 8:
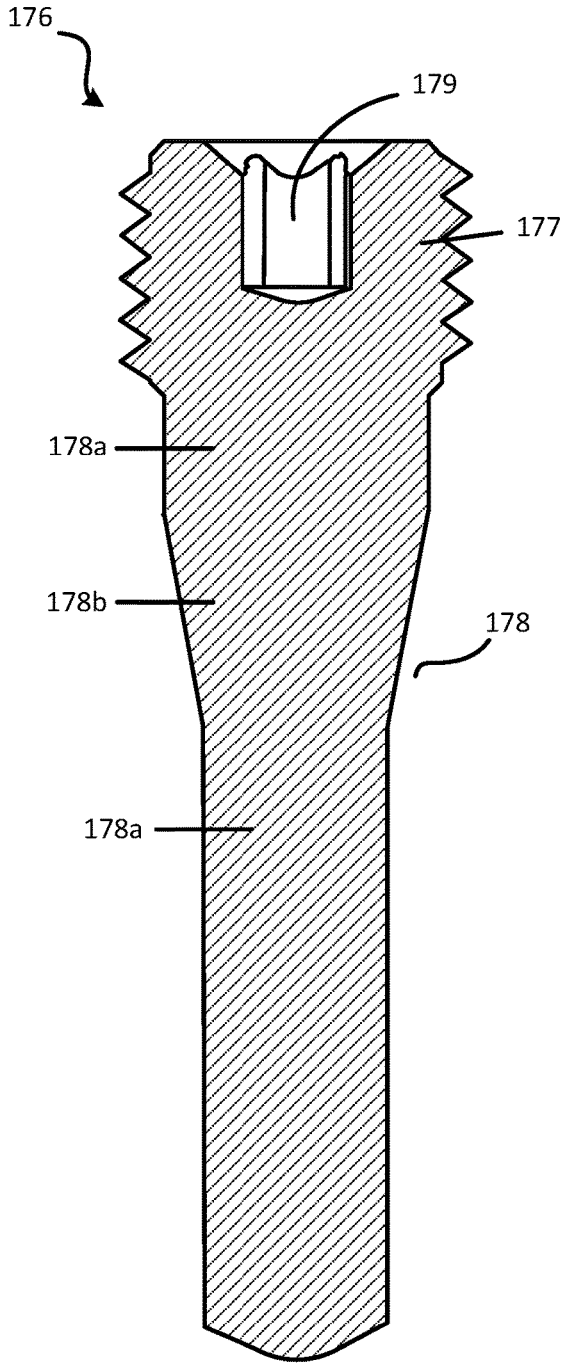
FIG. 8 is a cross-sectional view of a fastener that can be used to secure a compensator to a handgun barrel, in accordance with an embodiment of the present disclosure.

FIG. 7 illustrates a perspective view of a fastener 176 and FIG. 8 illustrates a cross-sectional view of a fastener 176, in accordance with some embodiments of the present disclosure. In these examples, the fastener 176 includes a head 177 and a shaft 178. The head 177 is threaded. The shaft 178 is smooth (i.e., non-threaded) and includes a tapered section 178*b* between a straight section 178*a* and the head 177. In this example, the shaft 178 further includes a straight section 178*a* between the tapered section 178*b* and the head 177. The head 177 defines a recess 179 configured for turning and/or advancing the fastener 176 into the fastener opening 126. The recess 179 can have a shape of a star, a hexagon, a plus, a slot, a triangle, a square, or other suitable geometry. In these examples, the tapered section 178*b* is positioned to engage the barrel 190. In other embodiments, the shaft 178 can be tapered along a majority portion or along its entire length. In yet other embodiments, the tip of the shaft 178 is threaded. For example, threads on the tip have an outer thread diameter that is equal to or smaller than the adjacent portion of the shaft 178. As will be appreciated, a straight section of the fastener may deviate slightly from being perfectly cylindrical, but the straight section is straight within manufacturing tolerances. Numerous variations and embodiments will be apparent in light of the present disclosure.

Figure 9:
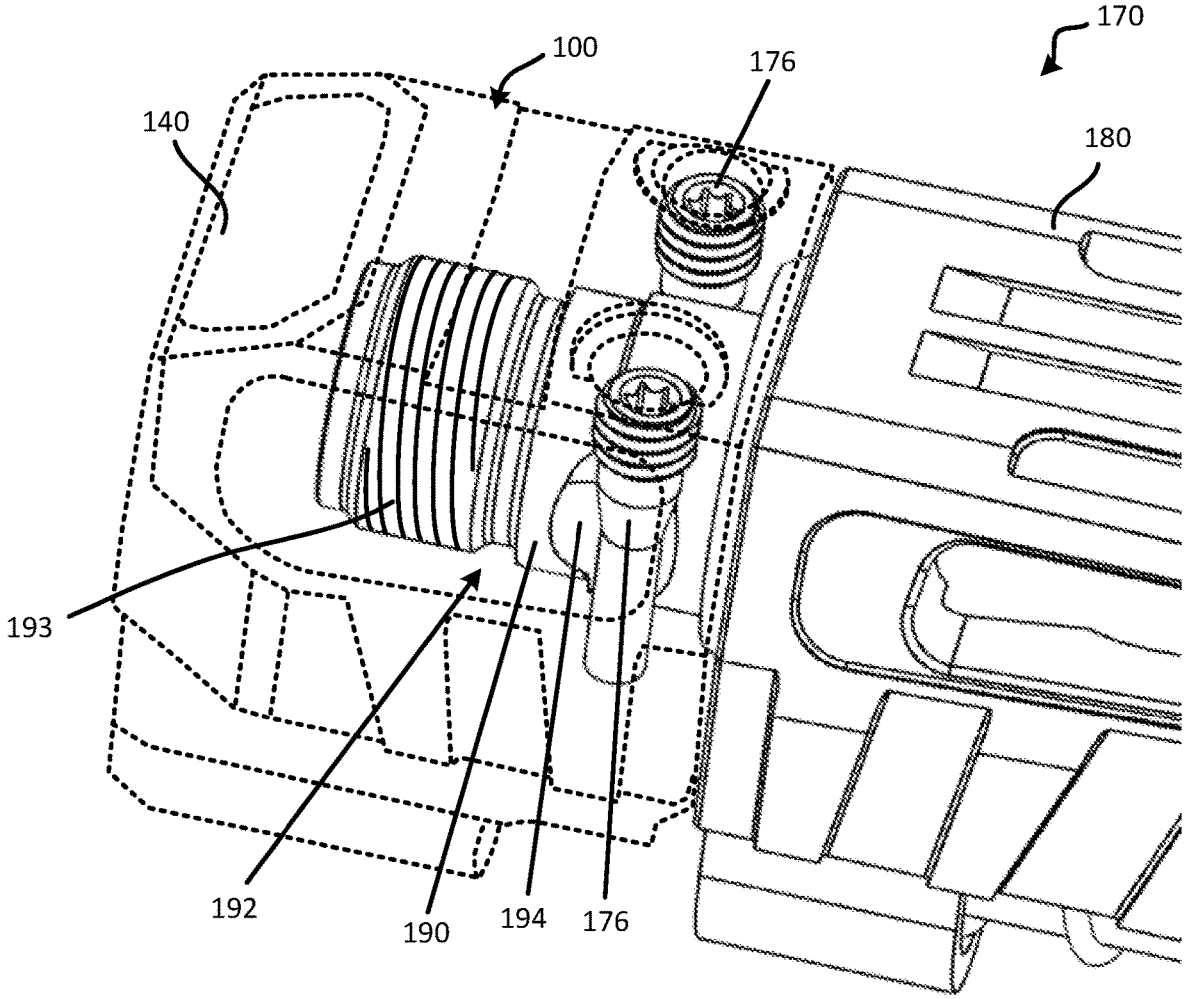
FIG. 9 is a top perspective view of a distal end portion of a handgun slide with a compensator attached to the barrel, where the compensator is illustrated as transparent to better show the barrel and fasteners, in accordance with an embodiment of the present disclosure.
Figure 10:
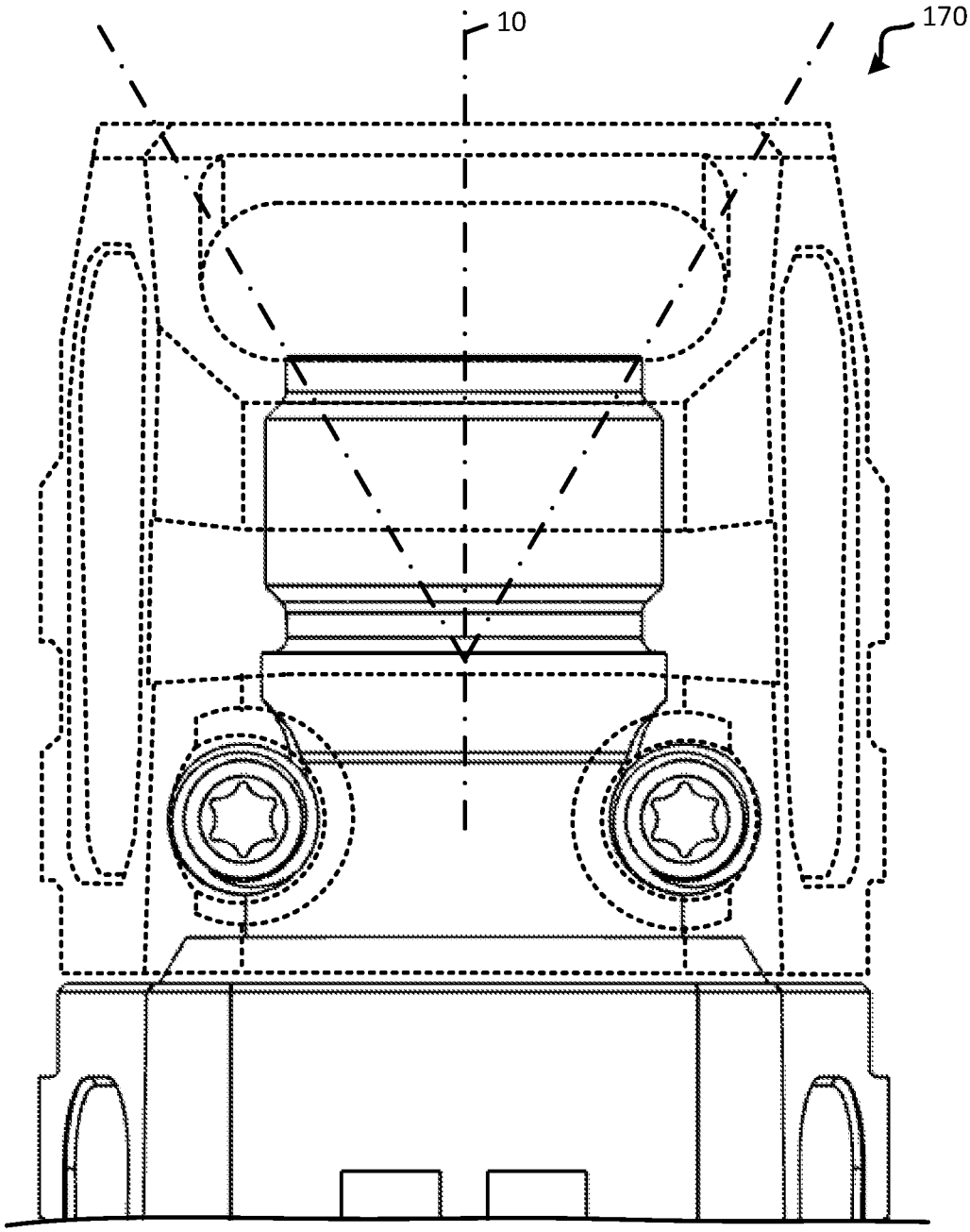
FIG. 10 is a top view of a distal end portion of a handgun slide with a compensator attached to the barrel, where the compensator is illustrated as transparent to better show the barrel and fasteners, in accordance with an embodiment of the present disclosure.

FIG. 9 illustrates a top and rear perspective view showing part of a slide assembly 170 with a compensator 100 attached to the handgun barrel 190 at the distal end of the slide 180, in accordance with an embodiment of the present disclosure. FIG. 10 illustrates a top view showing a portion of the slide assembly 170 of FIG. 7. In this example, the compensator 100 is illustrated as transparent to more clearly show the relative positions of the compensator 100, fasteners 176, and barrel 190. The fasteners 176, configured as taper pins with threaded heads in this example, extend vertically through the top wall 112 of the compensator 100 and engage respective flats 194 in the opposite sides of the distal end portion 192 of the barrel 190. Note that the port 140 is positioned distally of the end of the barrel 190. As shown in FIG. 10, the vast majority of the port 140 is within a 60° angle $\alpha$ that intersects the crown of the barrel 190.

Figure 11:
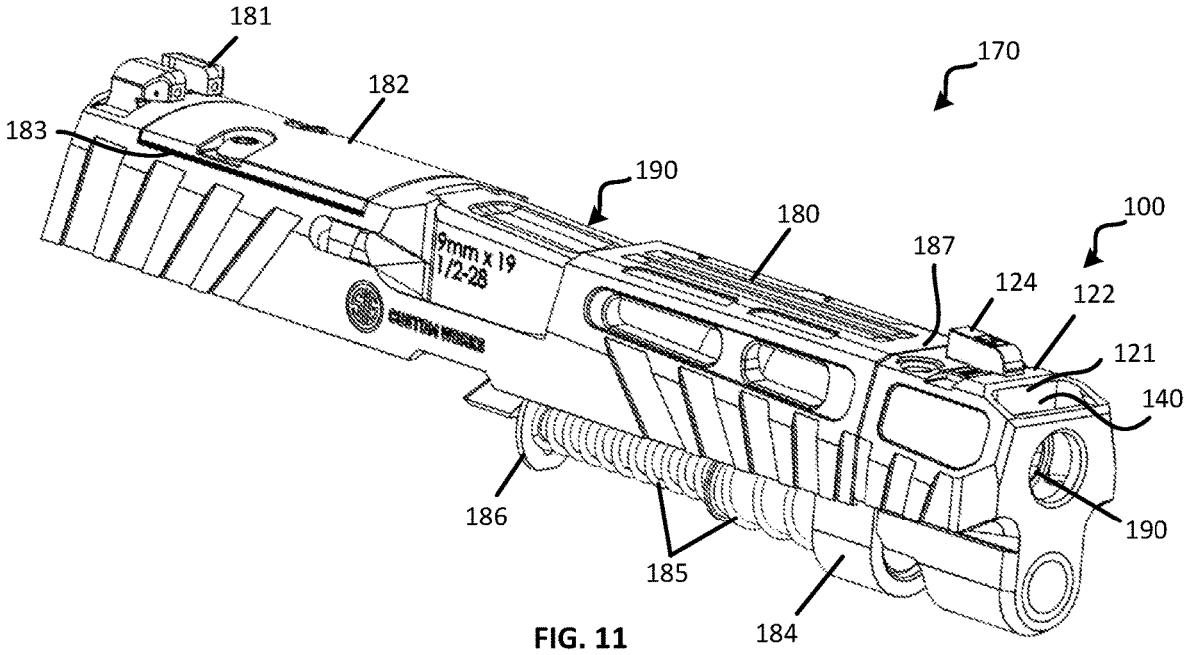
FIG. 11 is a front perspective view of a slide assembly that includes a compensator, in accordance with an embodiment of the present disclosure.
Figure 12:
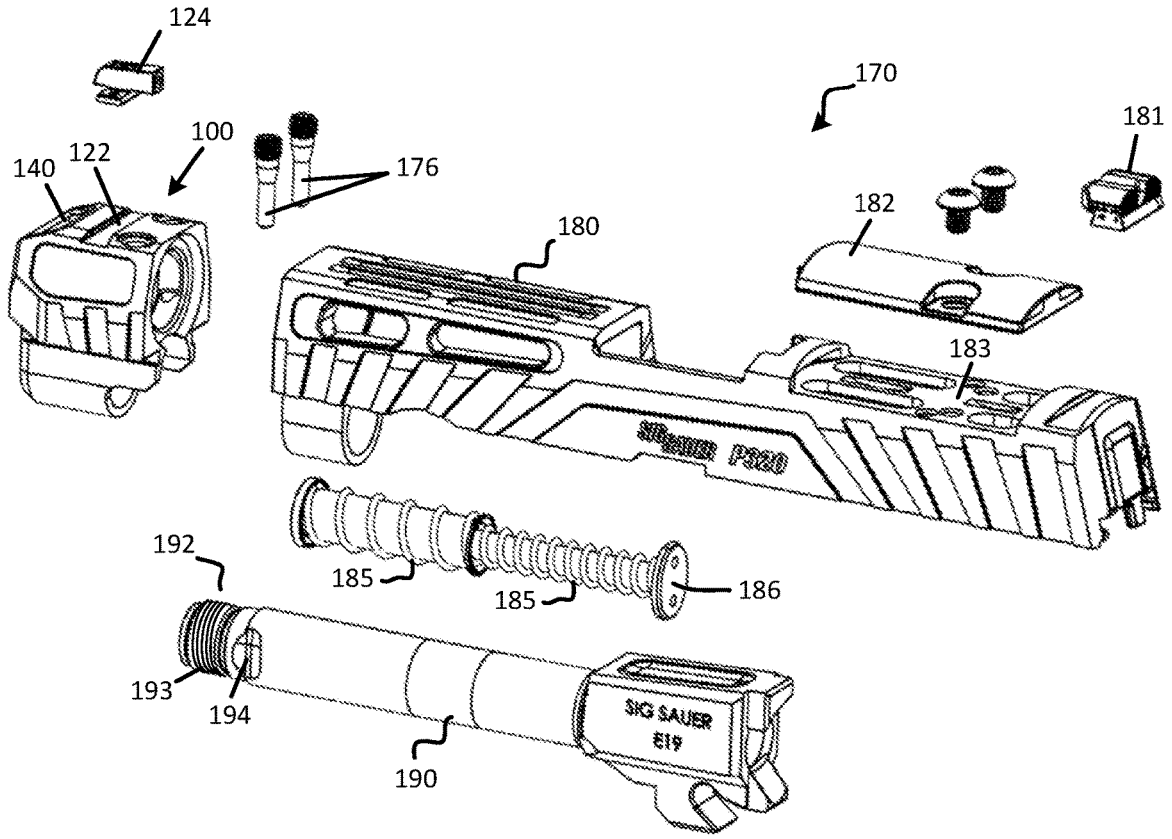
FIG. 12 is an exploded, side and rear perspective view showing components of a slide assembly, in accordance with an embodiment of the present disclosure.

FIG. 11 illustrates a front perspective view of a slide assembly 170 in an assembled form, in accordance with an embodiment of the present disclosure. FIG. 12 illustrates an exploded, side perspective view of the slide assembly 170 of FIG. 9. The slide assembly 170 includes a handgun slide 180 for a semiautomatic handgun. The slide 180 includes a rear sight 181 and optionally includes a cover plate 182 and associated recess 183 for mounting optics. At the distal end of the slide 180 is a spring box or receptacle 184 for a recoil spring(s) 185 and a spring guide 186.

The barrel 190 is configured to be received in the slide 180 with the distal end portion 192 protruding beyond the distal end 187 of the slide 180. As discussed above, the distal end portion 192 of the barrel 190 includes a threaded portion 193 with recesses 194 defined on opposite lateral sides of the barrel 190 for engaging respective taper pins 176. A front sight 124 can be mounted to the compensator 100 via the dovetail slot 122. As can be seen in FIG. 9, the port 140 is positioned distally of the barrel 190, which terminates at the intermediate wall 121.

Figure 13A:
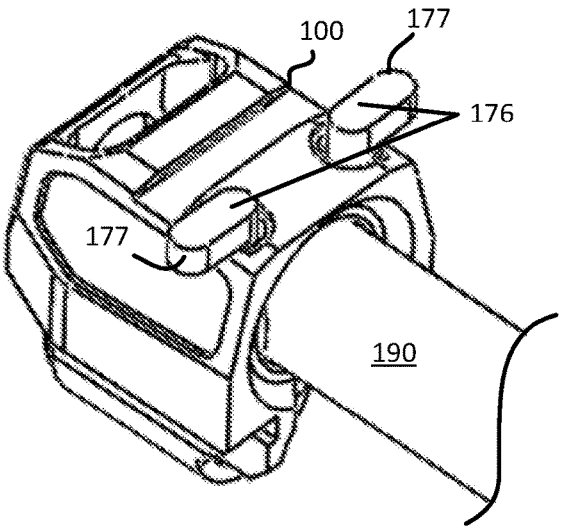
FIG. 13A illustrates a top and rear perspective view of a compensator installed on a barrel with fasteners in an unlocked position, in accordance with an embodiment of the present disclosure.
Figure 13B:
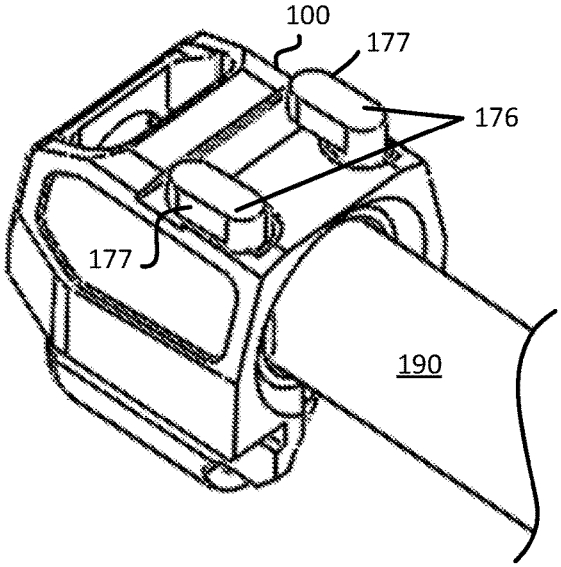
FIG. 13B illustrates a top and rear perspective view of the compensator of FIG. 13A with the fasteners 176 rotated to a locked position, in accordance with an embodiment of the present disclosure.

FIGS. 13A and 13B illustrate top and rear perspective views of a compensator 100 installed on a firearm barrel 190 with fasteners 176 in an unlocked position. In this example, each fastener 176 is configured as a cam and has an eccentric cross-sectional shape. In this example, the head 177 of each fastener 176 is configured as a lever. In other embodiments, the head 177 of the fastener 176 defines a recess with a shape of a slot, a plus, a star, a square, a triangle, or other shape suitable for engagement by a tool as needed to rotate the fastener 176.

Figure 13C:
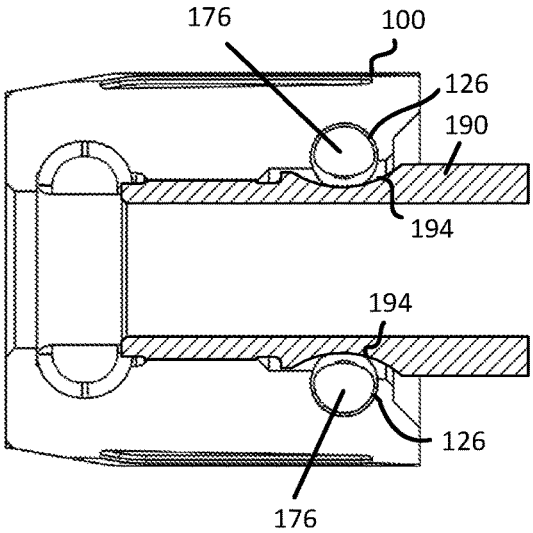
FIG. 13C illustrates a top and partial cross-sectional view of the compensator of FIG. 13A and shows the fasteners in an unlocked position and not engaging the barrel, in accordance with an embodiment of the present disclosure.
Figure 13D:
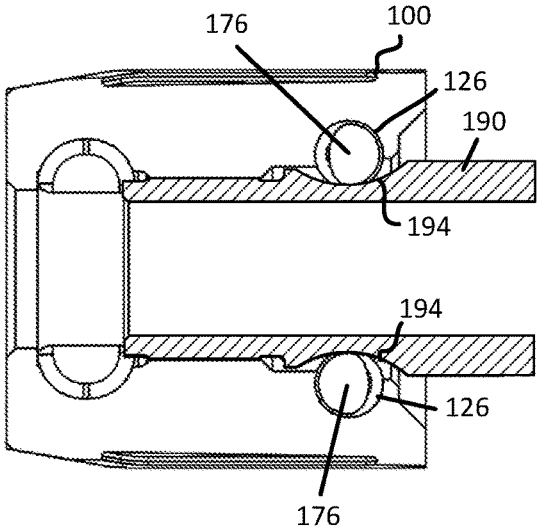
FIG. 13D illustrates a top and partial cross-sectional view of the compensator of FIG. 13B and shows the fasteners in a locked position and engaging the barrel, in accordance with an embodiment of the present disclosure.

FIGS. 13C and 13D illustrate top and partial cross-sectional views showing the compensator 100, fasteners 176, and barrel 190 of FIGS. 13A and 13B, respectively. In FIG. 13C, the fasteners are in the unlocked position and the smaller radius of the fastener 176 adjacent the barrel 190 results in the fastener 176 not engaging the barrel 190. When the fasteners 176 are rotated to the locked position, such as shown in FIG. 13D, the fasteners 176 engage the respective flat 194 on the sides of the barrel 190. Note also that each fastener 176 also engages the compensator 100 along the fastener opening, resulting in a mechanical stop that prevents the compensator 100 from rotation about the barrel 190.

Figure 14:
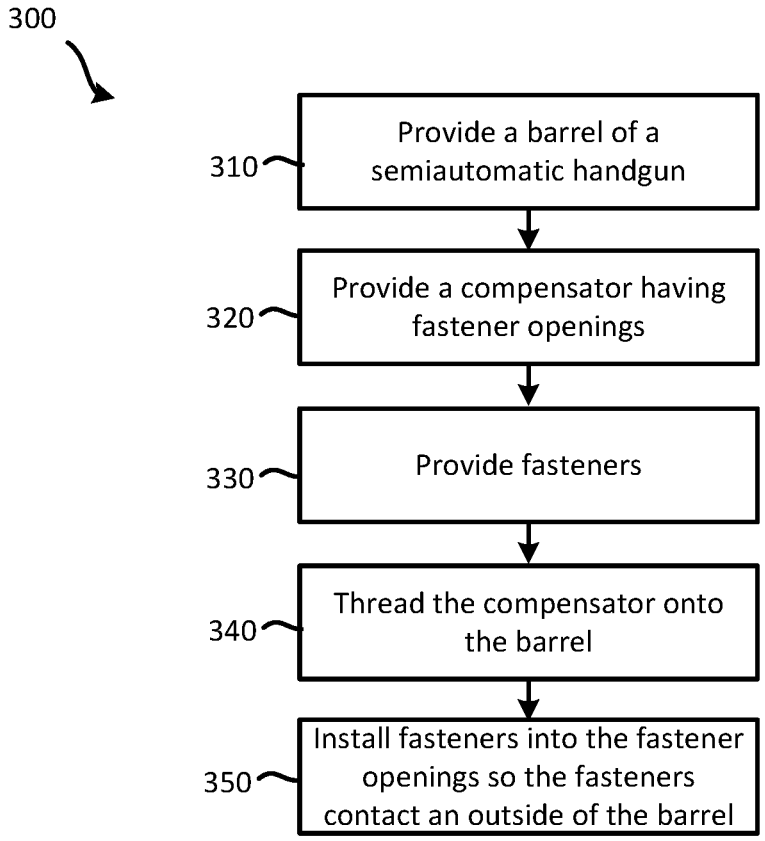
FIG. 14 illustrates steps in a method of installing a compensator on a handgun barrel, in accordance with some embodiments.

Referring now to FIG. 14, a method 300 of installing a compensator onto a handgun barrel is illustrated. Method 300 may begin with providing 310 a barrel for a semiautomatic handgun, the barrel including a distal end portion with a threaded portion and defining flats on opposite sides of the distal end portion. Method also includes providing 320 a compensator defining a barrel opening coaxially aligned with a projectile opening, the barrel opening threaded for installation on the barrel. The compensator further defines fastener openings through a wall of the compensator and one or more ports positioned to vent a portion of propellant gases from the barrel upon firing the handgun. In one example, the fastener openings extend through the top wall of the compensator. In some embodiments, the fastener openings are threaded.

Method 300 also includes providing 330 fasteners configured for installation in the fastener openings. In some embodiments, the fasteners are provided with a tapered portion. In some embodiments, the fasteners are provided with a head portion and a shaft portion, where the shaft portion can be straight or tapered along all or part of the shaft portion. In some embodiments, the head portion and/or a distal end portion of the shaft includes threads.

Method 300 proceeds with threading 340 the compensator onto the distal end portion of the handgun barrel and installing 350 the fasteners into the fastener openings so that each of the fasteners contacts an outside of the barrel. In embodiments where the fasteners have threads and part of the fastener openings are threaded, installing 350 the fasteners includes rotating the fasteners to threadably engage the threads on the fasteners with the threaded portion of the fastener openings. For example, when the head portion is threaded, the smooth shaft is inserted into the fastener opening, followed by using a tool (as needed) to advance and turn the fastener to thread the fastener head into the threaded portion of the fastener opening.

In another embodiment where the fasteners are configured as a cam pin having an eccentric cross-sectional shape, each fastener is installed into the fastener opening in an unlocked position so that the fastener does not engage or minimally engages the barrel. After the fastener is installed, the fasteners can be rotated to a locked position so that each fastener engages the barrel, thereby locking the compensator to the barrel and preventing rotation of the compensator with respect to the barrel.

Further Example Embodiments

The following examples pertain to further embodiments, from which numerous permutations and configurations will be apparent.

Example 1 is a recoil compensator for a semiautomatic handgun. The compensator includes a compensator body extending along a bore axis and defining a through-opening along the bore axis. The compensator body has a top wall, a bottom wall, side walls extending downward from the top wall to the bottom wall, and a distal wall connected to the top wall, the bottom wall, and the side walls, where the distal wall defines a projectile opening centered on the bore axis. An intermediate wall spaced axially from the distal wall and defines a barrel opening. The compensator body defines an open region axially between the distal wall and the intermediate wall, and between the top wall, bottom wall, and side walls. The compensator defines one or more fastener openings, such as through a top wall, and also defines a port between the distal wall and the intermediate wall, where the port is configured to vent a portion of propellant gases from a handgun barrel when the recoil compensator is installed on the handgun barrel.

Example 2 includes the subject matter of Example 1, where the through-opening includes a threaded barrel portion configured to mate with a threaded portion of the handgun barrel.

Example 3 includes the subject matter of Examples 1 or 2, where the one or more fastener openings includes a first fastener opening on a first side of the bore axis and a second fastener opening on an opposite second side of the bore axis, each of the first and second fastener openings configured and positioned to receive a fastener that contacts an outside surface of the handgun barrel.

Example 4 includes the subject matter of Example 3 and further comprises fasteners configured for installation in the fastener openings.

Example 5 includes the subject matter of Example 4, where each fastener opening is threaded through the top wall and each fastener includes a threaded head portion.

Example 6 includes the subject matter of Example 4, wherein the fastener has a shaft of eccentric cross-sectional shape.

Example 7 includes the subject matter of Examples 4 or 5, where the fastener has a tapered shaft.

Example 8 includes the subject matter of Examples 4 or 5, where each fastener includes a smooth shaft portion (i.e., non-threaded) that includes a tapered section.

Example 9 includes the subject matter of Example 8, where the tapered section is spaced from the head portion by a straight section.

Example 10 includes the subject matter of Example 9, where the straight section is a first straight section and the tapered section is between the first straight section and a second straight section.

Example 11 includes the subject matter of any one of Examples 3-10, where each of the first and second fastener openings defines a pocket on an inside of the compensator body, the pocket configured to receive a shaft portion of the fastener when the recoil compensator is installed on the handgun barrel.

Example 12 includes the subject matter of Example 11, where at least part of the pocket is threaded.

Example 13 includes the subject matter of any one of Examples 1-12, where the top wall defines a dovetail slot extending crosswise to the bore axis.

Example 14 includes the subject matter of any one of Examples 1-13, where the top wall includes a first portion extending generally parallel to the bore axis and a second portion connected to and extending downward and forward from the first portion, wherein the second portion defines the port.

Example 15 includes the subject matter of Example 14, where the second portion of the top wall defines an angle from 5-30° with respect to the bore axis.

Example 16 includes the subject matter of Example 15, where the angle is from 15-25°.

Example 17 includes the subject matter of Example 16, where the angle is about 20°.

Example 18 includes the subject matter of any one of Examples 1-17, where the compensator body is an upper portion, and the recoil compensator further comprises a lower portion connected to and positioned below the upper portion.

Example 19 includes the subject matter of Example 18, where the lower portion simulates a recoil spring box of a handgun slide.

Example 20 includes the subject matter of any one of Examples 1-19, where the projectile opening is smaller than the barrel opening.

Example 21 includes the subject matter of any one of Examples 1-20 and further comprises a front sight mounted to the top wall of the compensator body.

Example 22 includes the subject matter of Example 21, where the front sight is mounted to the compensator body using a dovetail slot.

Example 23 is a slide assembly for a semiautomatic handgun, the slide assembly including a slide extending longitudinally to a distal end and a barrel extending along a bore axis and having a distal end portion including threads and flats or recesses in opposite sides of the barrel, where the barrel configured to be received in the slide with the distal end portion extending beyond the distal end of the slide. The slide assembly also includes fasteners and a recoil compensator defining a through opening along a central axis, where the through opening includes a threaded portion configured to threadably engage the threads on the distal end portion of the barrel. The recoil compensator also defines fastener openings each corresponding to one of the flats or recesses in the opposite sides of the barrel and configured to receive one of the fasteners. The compensator further defines a port in a top wall. When the recoil compensator is installed on the barrel, a proximal end portion of the compensator is adjacent the distal end of the slide, the central axis is substantially coincident with the bore axis, the threaded portion engages the threads on the barrel with a distal end of the barrel positioned proximally of the port, and the fasteners are received in respective fastener openings and engage respective recesses or flats on opposite sides of the barrel. When the recoil compensator is installed on the barrel, the port is configured to vent a portion of propellant gases from the barrel upon firing the handgun.

Example 24 includes the subject matter of Example 23, wherein the recoil compensator has a compensator body including a top wall, a bottom wall, side walls extending downward from the top wall to the bottom wall, and a distal wall connected to the top wall, the bottom wall, and the side walls, where the distal wall defines the projectile opening. An intermediate wall is positioned proximally of and spaced axially from the distal wall, the intermediate wall defining the barrel opening. The compensator body defines an open region axially between the distal wall and the intermediate wall, and between the top wall, bottom wall, and side walls. The top wall defines the fastener openings and the port.

Example 25 includes the subject matter of Example 24, where the one or more fastener openings includes a first fastener opening on a first side of the bore axis and a second fastener opening on an opposite second side of the bore axis, each of the first and second fastener openings configured and positioned to receive one of the fasteners in contact with an outside of the handgun barrel.

Example 26 includes the subject matter of any one of Examples 23-25, wherein the fasteners have a shaft of eccentric cross-sectional shape.

Example 27 includes the subject matter of any one of Examples 23-25, where a portion of individual fastener openings is threaded and individual fasteners include threads.

Example 28 includes the subject matter of Example 27, where the threads are on a head portion of each fastener.

Example 29 includes the subject matter of Example 27, where the threads are on an end portion of each fastener.

Example 30 includes the subject matter of any one of Examples 23-29, where each of the fasteners has a tapered shaft.

Example 31 includes the subject matter of Example 23-29, where the fasteners include a smooth shaft portion that includes a tapered section.

Example 32 includes the subject matter of Example 31, where the tapered section is spaced from the head portion by a straight section.

Example 33 includes the subject matter of Example 31, where the straight section is a first straight section and the tapered section is between the first straight section and a second straight section.

Example 33 includes the subject matter of any one of Examples 23-33, where each of the fastener openings defines a pocket on an inside of the compensator body, the pocket configured to receive a portion of the fastener when the recoil compensator is installed on the handgun barrel.

Example 35 includes the subject matter of any one of Examples 23-34, where the top wall of the compensator defines a dovetail slot extending crosswise to the bore axis.

Example 36 includes the subject matter of any one of Examples 23-35, wherein the top wall includes a first portion extending generally parallel to the bore axis and a second portion connected to and extending downward and forward from the first portion, wherein the second portion defines the port.

Example 37 includes the subject matter of Example 36, where the second portion of the top wall defines an angle from 5-30° with respect to the bore axis.

Example 38 includes the subject matter of Example 37, where the angle is from 15-25°.

Example 39 includes the subject matter of Example 37, where the angle is about 20°.

Example 40 includes the subject matter of any one of Examples 23-39, where the compensator body is an upper portion and the recoil compensator further comprises a lower portion connected to and positioned below the upper portion.

Example 41 includes the subject matter of Example 40, wherein the lower portion simulates a recoil spring box of the slide.

Example 42 includes the subject matter of any one of Examples 23-41, where the projectile opening is smaller than the barrel opening.

Example 43 includes the subject matter of any one of Examples 23-42 and further comprises a front sight mounted to the top wall of the compensator body.

Example 44 is a semiautomatic handgun comprising the slide assembly of any one of Examples 23-43.

Example 45 is a method of installing a compensator on a handgun barrel, the method comprising providing a barrel for a semiautomatic handgun, the barrel including a distal end portion with a threaded portion and defining flats or recesses on opposite sides of the distal end portion; providing a compensator defining a barrel opening coaxially aligned with a projectile opening, the barrel opening threaded for installation on the barrel, wherein the compensator further defines fastener openings through a wall of the compensator and one or more ports positioned to vent a portion of propellant gases from the barrel upon firing the handgun; providing fasteners configured for installation in the fastener openings; threading the compensator onto the distal end portion of the handgun barrel; and installing fasteners into the fastener openings so that each of the fasteners contacts an outside of the barrel.

Example 46 includes the subject matter of Example 45, where providing the fasteners includes providing fasteners having a tapered portion.

Example 47 includes the subject matter of Example 46, where each of the fasteners includes a head portion and a shaft portion and the tapered portion is along the shaft portion.

Example 48 includes the subject matter of Example 47, where the tapered portion is part of the shaft portion.

Example 49 includes the subject matter of any one of Examples 45-48, where providing the fasteners includes providing fasteners having a threaded head portion, and wherein installing the fasteners includes engaging threads on the threaded head portion with threads in the fastener openings.

Example 50 includes the subject matter of Examples 45 or 46, where providing the fasteners includes providing fasteners having a shaft of eccentric cross-sectional shape and installing the fasteners includes installing each fastener into the fastener opening in an unlocked rotational position, then rotating each fastener to a locked position in which the shaft engages the outside surface of the barrel.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A recoil compensator for a semiautomatic handgun, comprising:

a compensator body extending along a bore axis and defining a through-opening along the bore axis, the compensator body including a top wall;

a bottom wall;

side walls extending downward from the top wall to the bottom wall;

a distal wall connected to the top wall, the bottom wall, and the side walls, the distal wall defining a projectile opening centered on the bore axis; and an intermediate wall spaced axially from the distal wall, the intermediate wall defining a barrel opening;

wherein the compensator body defines an open region axially between the distal wall and the intermediate wall, and between the top wall, bottom wall, and side walls;

wherein the top wall defines one or more fastener openings and defines a port between the distal wall and the intermediate wall, the port configured to vent a portion of propellant gases from a handgun barrel when the recoil compensator is installed on the handgun barrel; and wherein the bottom wall is closed from the intermediate wall to the distal wall.

2. The recoil compensator of claim 1, wherein the through-opening includes a threaded portion configured to threadably engage a threaded portion of the handgun barrel.

3. The recoil compensator of claim 1, wherein the one or more fastener openings includes a first fastener opening on a first side of the bore axis and a second fastener opening on an opposite second side of the bore axis, each of the first and second fastener openings configured and positioned to receive a fastener that contacts an outside surface of the handgun barrel.

4. The recoil compensator of claim 3, wherein each of the first and second fastener openings defines a pocket on an inside of the compensator body, the pocket configured to receive a shaft portion of the fastener when the recoil compensator is installed on the handgun barrel.

5. The recoil compensator of claim 4, wherein at least part of the pocket is threaded.

6. The recoil compensator of claim 1, further comprising fasteners configured for installation in the one or more fastener openings, wherein each fastener opening is threaded through the top wall and each fastener includes a threaded head portion.

7. The recoil compensator of claim 1, further comprising fasteners configured for installation in the fastener openings, wherein each fastener includes a smooth shaft portion that includes a tapered section.

8. The recoil compensator of claim 7, wherein the tapered section is spaced from the head portion by a straight section.

9. The recoil compensator of claim 8, wherein the straight section is a first straight section and the tapered section is between the first straight section and a second straight section.

10. The recoil compensator of claim 1, wherein the top wall includes a first portion extending generally parallel to the bore axis and a second portion connected to and extending downward and forward from the first portion at an angle from 5-30° with respect to the bore axis, wherein the second portion defines the port.

11. The recoil compensator of claim 1, wherein the compensator body is an upper portion, the recoil compensator further comprising a lower portion connected to and positioned below the upper portion, wherein the lower portion simulates a recoil spring box of a handgun slide.

12. The recoil compensator of claim 1, wherein the projectile opening is smaller than the barrel opening.

13. The recoil compensator of claim 1, further comprising a front sight mounted to the top wall of the compensator body.

14. A slide assembly for a semiautomatic handgun, comprising:

a slide extending longitudinally to a distal end;

a barrel extending along a bore axis and having a distal end portion including threads and flats or recesses in opposite sides of the barrel, the barrel configured to be received in the slide with the distal end portion extending beyond the distal end of the slide;

fasteners; and a recoil compensator defining a through opening along a central axis, the through opening including a threaded portion configured to threadably engage the threads on the distal end portion of the barrel, the recoil compensator further defining fastener openings each corresponding to one of the flats or recesses in opposite sides of the barrel and configured to receive one of the fasteners, and further defining a port in a top wall;

wherein when the recoil compensator is installed on the barrel, a proximal end portion of the compensator is adjacent the distal end of the slide, the central axis is substantially coincident with the bore axis, the threaded portion threadably engages the threads on the barrel with a distal end of the barrel positioned proximally of the port, and the fasteners are received in respective fastener openings and engage respective flats or recesses on opposite sides of the barrel; and wherein when the recoil compensator is installed on the barrel, the port is configured to vent a portion of propellant gases from the barrel upon firing the handgun.

15. The slide assembly of claim 14, wherein the recoil compensator comprises:

a compensator body including a top wall;

a bottom wall;

side walls extending downward from the top wall to the bottom wall;

a distal wall connected to the top wall, the bottom wall, and the side walls, the distal wall defining the projectile opening; and an intermediate wall positioned proximally of and spaced axially from the distal wall, the intermediate wall defining the barrel opening;

wherein the compensator body defines an open region axially between the distal wall and the intermediate wall, and between the top wall, bottom wall, and side walls; and wherein the top wall defines the fastener openings and the port.

16. The slide assembly of claim 14, wherein each of the fastener openings defines a pocket on an inside of the compensator body, the pocket configured to receive a portion of the fastener when the recoil compensator is installed on the handgun barrel.

17. The slide assembly of claim 14, wherein the top wall includes a first portion extending generally parallel to the bore axis and a second portion connected to and extending downward and forward from the first portion at an angle from 5-30° with respect to the bore axis, wherein the second portion defines the port.

18. The slide assembly of claim 14, wherein the compensator body is an upper portion, the recoil compensator further comprising a lower portion connected to and positioned below the upper portion, wherein the lower portion simulates a recoil spring box of the slide.

19. The slide assembly of claim 14, wherein the projectile opening is smaller than the barrel opening.

20. A method of installing a compensator on a handgun barrel, the method comprising:

providing a barrel for a semiautomatic handgun, the barrel including a distal end portion with a threaded portion and defining flats or recesses on opposite sides of the distal end portion;

providing a compensator defining a barrel opening coaxially aligned with a projectile opening, the barrel opening being threaded for installation on the barrel; wherein the compensator further defines fastener openings through a wall of the compensator and one or more ports positioned to vent a portion of propellant gases from the barrel upon firing the handgun;

providing fasteners configured for installation in the fastener openings;

threading the compensator onto the distal end portion of the handgun barrel; and installing fasteners into the fastener openings so that each of the fasteners contacts an outside of the barrel along one of the corresponding flats or recesses.

21. The method of claim 20, wherein providing the fasteners includes providing fasteners having a head portion and a shaft portion, wherein at least part of the shaft portion is tapered.

22. The method of claim 20, wherein providing the fasteners includes providing fasteners having a threaded head portion, and wherein installing the fasteners includes engaging threads on the threaded head portion with threads in the fastener openings.

* * * * *